US009528344B2

(12) United States Patent
Vick, Jr. et al.

(10) Patent No.: US 9,528,344 B2
(45) Date of Patent: Dec. 27, 2016

(54) SAFETY VALVE WITH INDEPENDENT FLOW TUBE

(75) Inventors: James Dan Vick, Jr., Dallas, TX (US); Leo G. Collins, Farmers Branch, TX (US); Jeremy Pike Brimer, Wylie, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 425 days.

(21) Appl. No.: 13/993,815

(22) PCT Filed: Jun. 27, 2012

(86) PCT No.: PCT/US2012/044310

§ 371 (c)(1),
(2), (4) Date: Jun. 13, 2013

(87) PCT Pub. No.: WO2014/003731

PCT Pub. Date: Jan. 3, 2014

(65) Prior Publication Data

US 2014/0000870 A1 Jan. 2, 2014

(51) Int. Cl.

| | |
|---|---|
| ***E21B 34/06*** | (2006.01) |
| ***E21B 34/10*** | (2006.01) |
| *E21B 34/00* | (2006.01) |

(52) U.S. Cl.

CPC ..... *E21B 34/06* (2013.01); *E21B 34/10* (2013.01); *E21B 2034/005* (2013.01)

(58) Field of Classification Search

CPC .... E21B 2034/005; E21B 34/10; E21B 34/00; E21B 34/06

See application file for complete search history.

(56) References Cited

U.S. PATENT DOCUMENTS

| | | | | |
|---|---|---|---|---|
| 3,981,358 | A * | 9/1976 | Watkins | E21B 34/102 166/323 |
| 4,077,473 | A | 3/1978 | Watkins et al. | |
| 4,161,960 | A | 7/1979 | Watkins | |
| 4,449,587 | A | 5/1984 | Rodenberger et al. | |
| 4,890,674 | A | 1/1990 | Le | |
| 5,137,089 | A * | 8/1992 | Smith | E21B 34/06 166/321 |
| 6,662,886 | B2 | 12/2003 | Russell | |
| 2011/0083858 | A1 * | 4/2011 | Johnston | E21B 34/10 166/373 |

OTHER PUBLICATIONS

Singapore Patent Application No. SG11201408048V , Written Opinion, mailed Dec. 8, 2015, 2 pages.
Australian Application No. 2012383527, Australian Examination Report mailed Aug. 21, 2015, 3 pages.
Singapore Patent Application No. SG11201408048V , Second Written Opinion, mailed Jul. 7, 2016.

* cited by examiner

*Primary Examiner* — Elizabeth Gitlin
(74) *Attorney, Agent, or Firm* — Kilpatrick Townsend & Stockton LLP

(57) ABSTRACT

A safety valve can be disposed in a wellbore that is through a fluid-producing formation. The safety valve can include a flow tube that is allowed to move at least partially independent, or free, from a piston assembly to avoid negative effects from forces on the flow tube from a closing assembly, such as one including a flapper. For example, the flow tube may not be required to be rigidly connected to a piston assembly such that the flow tube can move more than the piston assembly moves.

20 Claims, 5 Drawing Sheets

SAFETY VALVE WITH INDEPENDENT FLOW TUBE

CROSS-REFERENCE TO RELATED APPLICATIONS

This is a U.S. national phase under 35 U.S.C. 371 of International Patent Application No. PCT/US2012/044310, titled "Safety Valve With Independent Flow Tube," filed Jun. 27, 2012, the entirety of which is incorporated herein by reference.

TECHNICAL FIELD OF THE INVENTION

The present invention relates generally to devices for controlling fluid flow in a bore in a subterranean formation and, more particularly (although not necessarily exclusively), to devices that are capable of controllably preventing or allowing the production of fluid through a well traversing a subterranean formation using a flow tube that can move at least partially independent to a piston.

BACKGROUND

Production tubing can be positioned in a downhole environment of a wellbore in a fluid-producing formation. Fluid from the formation can travel through the production tubing to a surface of the wellbore. The production tubing can include a safety valve that is controllable by hydraulics, electrical signals, or another control mechanism. The safety valve may be a sub-surface safety valve. The safety valve can open to allow fluid to flow through the production tubing. The safety valve can close to prevent fluid from flowing through the production tubing.

For example, in response to an accident, a control action at the surface, or otherwise a decrease of hydraulic fluid pressure, the safety valve can allow a flow tube that is part of the safety valve and the production tubing to move toward the surface, resulting in a flapper to close and seal the flow tube (and thus the production tubing) from fluid from the formation.

A closing flapper or other closing mechanism can exert force on the flow tube, which may result in damage to the flapper assembly, a pressure spike in a control line for the hydraulic fluid, and other undesirable results. For example, as the flapper is close to closing, the pressure differential across the flapper can force the flow tube toward the surface with a large amount of force. The large amount of force may break the flapper or seat hinge, shear a hinge pin, warp the flow tube, and impart momentum into the flow tube. In some situations, 1250 pound force (lbf) is transferred to the flow tube for every 100 psi of pressure differential across the flapper.

Safety valves are desirable that can handle forces from flappers or other closing mechanisms during closing.

SUMMARY

Certain aspects and features of the present invention are directed to a safety valve that can include a flow tube that is allowed to move at least partially independent, or free, from a piston assembly to avoid negative effects from forces on the flow tube from a closing assembly.

One aspect relates to a safety valve that can be disposed in a wellbore through a fluid-producing formation. The safety valve includes a piston assembly, a flow tube, a closing assembly, and a connecting assembly. The piston assembly can be controlled from a surface of the wellbore. The closing assembly can allow and prevent fluid flow through an end of the flow tube. The connecting assembly can be positioned between the flow tube and the piston assembly. The connecting assembly can allow the flow tube to move toward the surface of the wellbore in response to a closing force exerted on the flow tube by the closing assembly and at least partially independent of movement toward the surface of the wellbore by at least part of the piston assembly.

Another aspect relates to a connecting assembly for a safety valve that can be disposed in a wellbore through a fluid-producing formation. The connecting assembly includes a first end, a second end, and a receiving member. The first end can couple to a piston assembly. The second end can engage a power spring that supports the flow tube. The receiving member can allow the flow tube to move toward the surface of the wellbore in response to a closing force exerted on the flow tube by a flapper and at least partially independent of movement toward the surface of the wellbore by at least part of the piston assembly.

Another aspect relates to a safety valve that can be disposed in a wellbore through a fluid-producing formation. The safety valve includes a piston rod, a flow tube, a normally-closed flapper, and a ring assembly. The piston rod can be controlled by a piston and by hydraulic fluid introduced into the wellbore from the surface. The normally-closed flapper can be positioned proximate to an end of the flow tube for allowing and preventing fluid flow through the end of the flow tube. The ring assembly can be positioned between the flow tube and the piston assembly and external to part of the flow tube. The ring assembly can allow the flow tube to move toward the surface of the wellbore in response to a closing force exerted on the flow tube by the normally-closed flapper and at least partially independent of movement toward the surface of the wellbore by the piston rod.

These illustrative aspects are mentioned not to limit or define the invention, but to provide examples to aid understanding of the inventive concepts disclosed. Other aspects, advantages, and features of the present invention will become apparent after review of the entire disclosure, figures, and claims.

DETAILED DESCRIPTION

Figure 1:
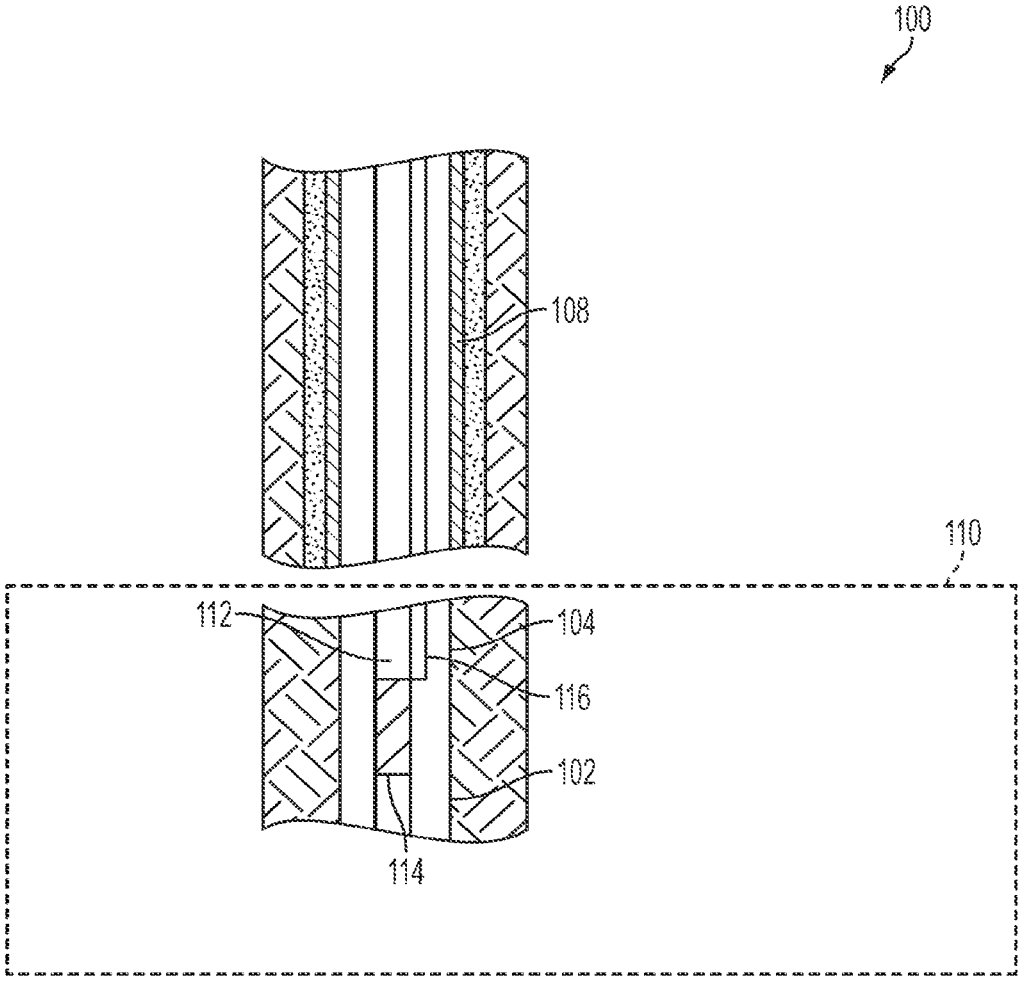
FIG. 1 is a schematic illustration of a well system having a safety valve according to one aspect of the present invention.

Certain aspects and features of the present invention are directed to a safety valve that can be disposed in a wellbore that is through a fluid-producing formation. The safety valve can include a flow tube that is allowed to move at least partially independent, or free, from a piston assembly to avoid negative effects from forces on the flow tube from a closing assembly, such as one including a flapper. For example, the flow tube may not be required to be rigidly connected to a piston assembly and instead "floats" such that the flow tube can move more than the piston assembly moves.

A safety valve according to one example includes a connecting assembly between a flow tube and a piston assembly. The safety valve may be a sub-surface safety valve. The piston assembly may include a piston and a piston rod that are configured to move in response to the presence or absence of hydraulic fluid pressure, or in response to another control mechanism. A closing assembly may be located proximate to an end of the flow tube and be capable of closing and opening for controlling fluid flow to the flow tube. The end of the flow tube may be an opening into which fluid can flow, but is not necessarily an end of the production tubing, which may extend many feet into the wellbore past the flow tube. A closing assembly may include components such as a flapper valve, a ball valve, or a poppet valve. For example, a flapper valve can include a spring-loaded plate that can open to allow formation fluids to flow into the flow tube and that can close to prevent formation fluids from flowing into the flow tube.

The piston assembly can move away from the surface in response to an increase in hydraulic fluid pressure, or some other control mechanism, that may be introduced via a control line. The piston assembly moving away from the surface can exert a force on the connecting assembly to move correspondingly in a direction away from the surface. Moving correspondingly can include a component moving the same or similar distance as another component. The connecting assembly can exert a force on the flow tube (either directly or indirectly, such as through a power spring) to cause the flow tube to move correspondingly in a direction away from the surface. The flow tube moving away from the surface can cause the closing assembly to open and allow fluid to flow through the flow tube toward the surface.

Some event, such as controls from the surface or an emergency with respect to the well, may result in a reduction or absence of hydraulic fluid pressure. In response to the reduction or absence of hydraulic fluid pressure, the piston assembly may move toward the surface and the connecting assembly may move correspondingly toward the surface. The flow tube may also move correspondingly toward the surface. As the flow tube moves toward the surface, the closing assembly can begin to close an end of the flow tube. As the closing assembly begins to close, the closing assembly can exert a force on the flow tube in a direction toward the surface. For example, fluid may be flowing at 200 ft/s, resulting in a relatively large force on the closing assembly as it begins to close. The piston assembly, however, may not be capable of allowing the flow tube to move toward the surface faster to diminish or remove the forces exerted on the flow tube as the closing assembly is closing. For example, the piston assembly may move toward the surface relatively slowly. The connecting assembly can be configured to allow the flow tube to move at least partially independent of the piston assembly for some additional distance toward the surface to allow the closing assembly to close faster and diminish or reduce the forces exerted on the flow tube by the closing assembly during closing. As the piston assembly moves toward the surface more than the additional distance, the flow tube can resume moving correspondingly with respect to the piston assembly toward the surface.

In one example, the connecting assembly includes a ring disposed external to the flow tube and defining a chamber between an outer wall of the flow tube and an inner wall of the ring. The chamber can allow the flow tube to move toward the surface at least partially independent of movement by the piston assembly in response to a force from the closing assembly. In some aspects, the connecting assembly may include a take-up spring disposed in the chamber. The take-up spring can prevent the flow tube from moving toward the surface unintentionally, such as when the flow tube is in a position such as that the closing assembly is open, but can allow forces exerted on the flow tube during closing to overcome the biasing force of the take-up spring and allow the flow tube to move at least partially independent to the piston assembly. As the force exerted on the flow tube during closing diminishes, the take-up spring can bias the flow tube so that the flow tube can resume moving toward the surface correspondingly with the piston assembly.

A connecting assembly according to some aspects may allow a flow tube to move a half inch or more at least partially independent to movement by the piston assembly. For example, a connecting assembly may allow the flow tube to move up to 2-3 inches at least partially independent to movement by the piston assembly. In some implementations, the connecting assembly may allow the flow tube to move within a range of 1 to 6 or more inches at least partially independent to movement by the piston assembly.

Safety valves according to certain aspects may reduce forces on a pin or hinge of a closing assembly during slam closure, reduce forces on an upstop of the safety valve during slam closure, reduce damage between the closing assembly and an opening prong, and/or allow a closing assembly to close faster. A safety valve may reduce pressure spikes in a control line during slam closure, reducing forces that may cause damage to a control line fitting, piston, seals, and piston rod. For example, hydraulic fluid pressure in the control line during closing may be around 2000 psi. Forces exerted on the flow tube, and transferred to the hydraulic fluid, may increase the hydraulic fluid pressure to 34,000 psi. A safety valve according to some examples can reduce or eliminate such spiking in response to closing forces. Certain safety valves may provide a spring force on an upstop seat in the closed position, reduce stresses experienced by a flapper or seat hinge of the closing assembly, and/or align the spring force with the piston.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative features but, like the illustrative features, should not be used to limit the present invention.

FIG. 1 schematically depicts a well system 100 with a safety valve assembly 114 according to certain aspects. The well system 100 includes a wellbore 102 extending through various earth strata. The wellbore 102 has a substantially vertical section 104. The substantially vertical section 104 may include a casing string 108 cemented at an upper portion of the substantially vertical section 104. The substantially vertical section 104 extends through a hydrocarbon-bearing subterranean formation 110.

A production tubing 112 extends from the surface within wellbore 102. The production tubing 112 can define a passageway providing a conduit for production of formation fluids to the surface.

The safety valve assembly 114 can be a subassembly of the production tubing 112. A control line 116 may be positioned between the safety valve assembly 114 and the surface. The control line 116 can be in communication with the safety valve assembly 114 for delivering controls, such as through hydraulic fluid pressure. The safety valve assembly 114 can open and close in response to the presence and absence of hydraulic fluid pressure to control fluid flow through the production tubing 112.

Although FIG. 1 depicts the safety valve assembly 114 positioned in the substantially vertical section 104, a safety valve assembly 114 can be located, additionally or alternatively, in a deviated section, such as a substantially horizontal section. In some aspects, safety valve assembly 114 can be disposed in wellbores having both a substantially vertical section and a substantially horizontal section. Safety valve assembly 114 can be disposed in open hole environments, such as is depicted in FIG. 1, or in cased wells.

Figure 2:
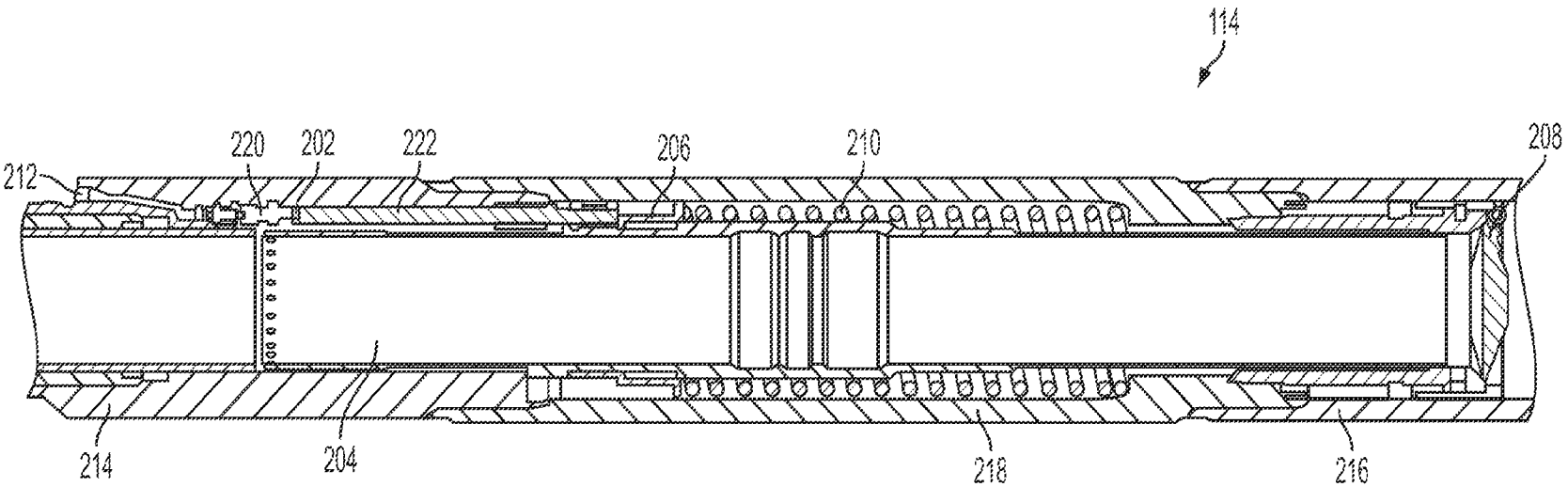
FIG. 2 is a cross-sectional side view of the safety valve of FIG. 1 according to one aspect of the present invention.

FIG. 2 depicts via cross-section the safety valve assembly 114 according to one aspect. The safety valve assembly 114 includes a piston assembly 202, a flow tube 204, a connecting assembly 206, and a closing assembly 208. The safety valve assembly 114 also includes a power spring 210 and a control line port 212.

The piston assembly 202 and control line port 212 may be in a top subassembly 214. The top subassembly 214 may be configured to couple the safety valve 114 to another part of the production tubing that is closer to the surface than the safety valve 114. The closing assembly 208 may be in a bottom subassembly 216. The bottom subassembly 216 may be configured to couple the safety valve 114 to another part of the production tubing that is farther from the surface that the safety valve 114. The connecting assembly 206 and power spring 210 may be in a spring housing 218.

The piston assembly 202 may include a piston (part of which is shown as 220) and a piston rod 222. Hydraulic fluid pressure can be received through port 212 to cause the piston to move away from or toward the surface of the wellbore. The moving piston can cause the piston rod 222 to move correspondingly. The piston rod 22 can coupled to the connecting assembly 206 and cause the connecting assembly 206 to move correspondingly.

The connecting assembly 206 can engage the power spring 210. For example, the connecting assembly 206 may be coupled, directly or indirectly, to the power spring 210 or physically configured to contact the power spring 210, to engage the power spring 210. The connecting assembly 206 can transfer force from the piston rod 222 to the power spring 210 to compress the power spring 210. The power spring 210 may be biased to allow the closing assembly 208 to be normally closed. For example, when hydraulic pressure is reduced at the piston, the power spring 210 can exert a force on the connecting assembly 206 and the piston rod 222 to move toward the surface. The power spring 210 in FIG. 2 has a round cross-sectional shape, but power springs having other cross-sectional shapes can be used.

The compressed power spring 210 can allow or cause the flow tube 204 to move away from the surface of the wellbore and open the closing assembly 208. Fluid can flow through the flow tube 204 when the closing assembly 208 is open.

Figure 3:
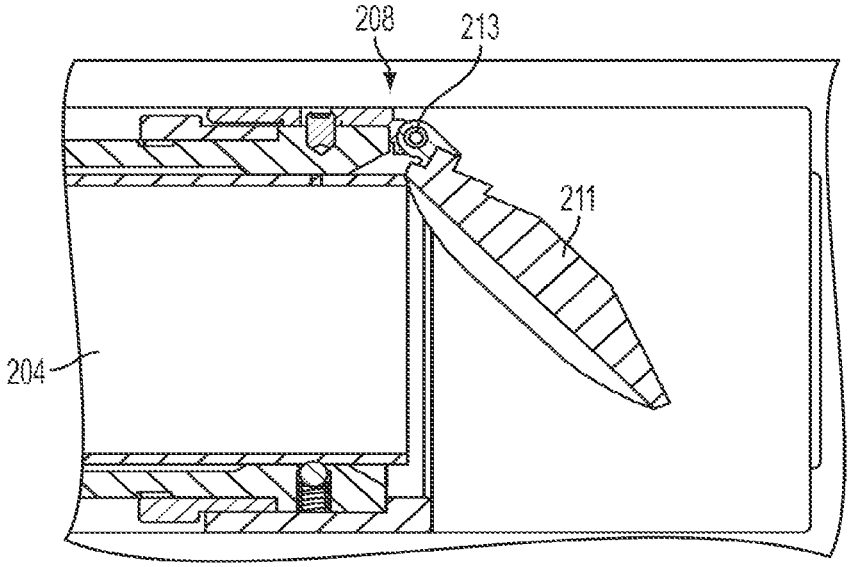
FIG. 3 is a cross-sectional side view of part of the safety valve including a closing assembly of FIG. 1 according to one aspect of the present invention.

FIG. 3 depicts part of the safety valve 114 via cross-section that includes the closing assembly 208 and the flow tube 204. The closing assembly 208 in FIG. 3 includes a flapper 211 and a spring-loaded hinge 213 that is configured to cause the flapper 211 to be normally closed to seal the end of the flow tube 204. For example, the flapper 211 can seal against a flapper seal in a closed position and be proximate to an end of the flow tube 204. As the flapper 211 closes due to the flow tube 204 moving toward the surface, the flapper 211 moves from a substantially horizontal position relative to the flow tube 204 (i.e. open position) to a substantially vertical position relative to the flow tube 204 (i.e. closed position). FIG. 3 depicts the flapper 211 in a partially closed, or in a closing position. In the partially closed position, fluid flowing toward the flow tube 204 may exert a relatively large force on the flapper 211, which is transferred to the flow tube 204 at portions of the flow tube 204 that contacts the flapper 211. A connecting assembly according to some embodiments, can allow the flow tube 204 to move toward the surface in response to this force and at least partially independent to movement allowed by a piston.

Figure 4:
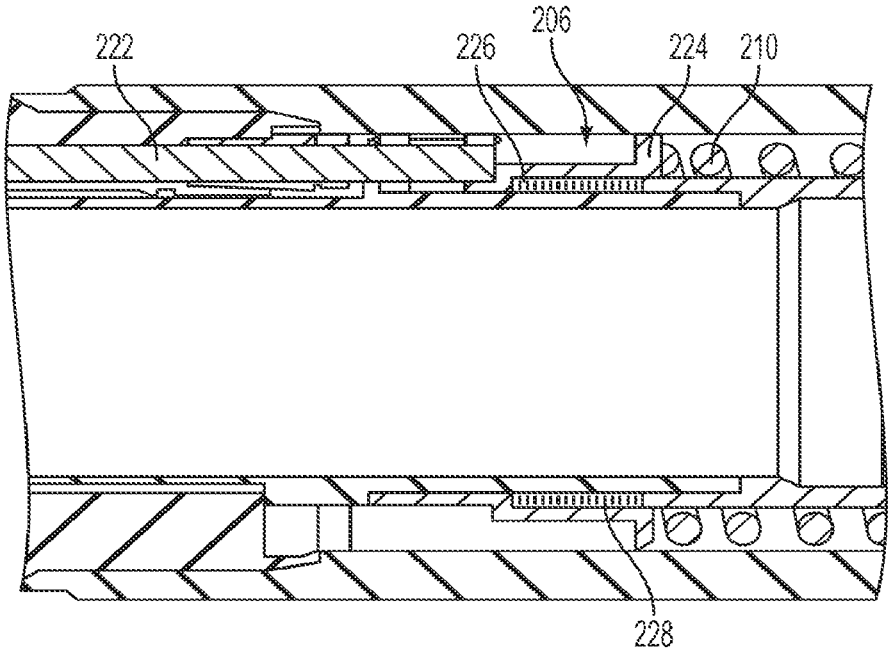
FIG. 4 is a cross-sectional side view of part of the safety valve of FIG. 1 including a connecting assembly according to one aspect of the present invention.

FIG. 4 depicts part of the safety valve 114 via cross-section that includes the connecting assembly 206 external to the flow tube 204. The connecting assembly 206 is depicted as coupling to the piston rod 222 and engaging the power spring 210.

The connecting assembly 206 includes a ring 224 and a take-up spring 228 that is disposed in a chamber 226 defined by the ring 224. The chamber 226 can be between an outer wall of the flow tube 204 and at least part of the inner wall of the ring 224. The take-up spring 228 may be biased to extend outward, such as away from the surface. The take-up spring 228 in FIG. 3 has a rectangular cross-sectional shape, but take-up springs according to other aspects may have other cross-sectional shapes. Connecting assemblies according to other aspects do not include a take-up spring. Instead, these connecting assemblies can rely on gravitational forces to hold a flow tube normally outward unless a force overcomes the gravitations force.

The chamber 226 can receive part of the flow tube 204 as the closing assembly 208 is closing. Force exerted on the flow tube 204 by the flapper 211 as in FIG. 3 may cause the take-up spring 228 to compress and allow the flow tube 204 to move toward the surface more than the piston moves towards the surface at a particular point in time during closing of the closing assembly 208.

For example and referring to FIGS. 2-4, the piston may have moved 3 inches toward the surface as allowed by a reduction in hydraulic fluid pressure. In response, the piston rod 222, connecting assembly 206, and flow tube 204 can move 3 inches (or an amount close to 3 inches) toward the surface. The piston may continue to move, relatively slowly toward the surface. After the flow tube 204 has moved about 3 inches, the flapper 211 may exert a force on the flow tube 204 in the process of closing. This force may cause the flow tube 204 to move toward the surface more than an amount that the piston has moved. The flow tube 204, in response to force from the flapper 211, can be received into the chamber 226 and compress the take-up spring 228 and move an additional 2 inches, for example, more than the piston has moved.

The flow tube 204 can move these additional 2 inches at least partially independent to movement of the piston. For example, the piston may move a small amount during this process, and the flow tube 204 can move an amount corresponding to this small amount, in addition to approximately 2 inches that the flow tube 204 is allowed to move. The flow tube 204 moving the additional 2 inches can allow the flapper 211 to close faster than otherwise and reduce the effects of the force of the flapper 211 on the flow tube 204 and other system components during closing. After the piston has moved toward the surface the additional 2 inches, following the example, the flow tube 204 can resume moving correspondingly, or substantially correspondingly, to the movement of the piston.

Figure 5:
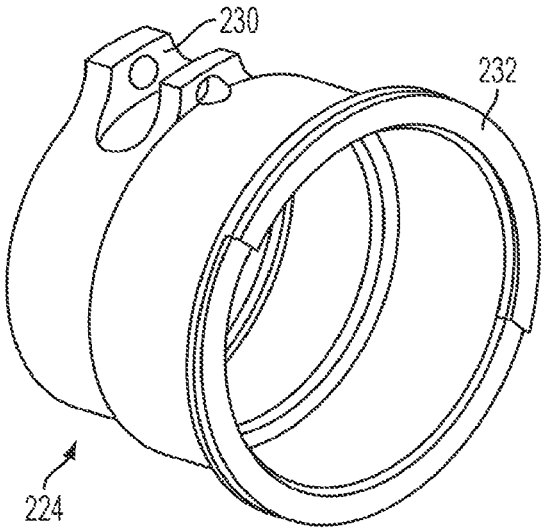
FIG. 5 is a perspective view of a ring that is part of a connecting assembly of the safety valve of FIG. 1 according to one aspect of the present invention.

FIG. 5 depicts via perspective view one example of the ring 224 that may be used in a connecting assembly 206. The ring 224 includes a connecting end 230 by which the ring 224 can couple to a piston rod. The connecting end 230 can include openings through which a piston rod can be positioned and coupled to the ring 224 using nuts or another connecting mechanism. On the other end of the ring 224 is a raised boss 232 that can engage a power spring via contact, but not a connection, to the power spring. For example, the power spring may be ground flat to contact the raised boss 232. In some aspects, the raised boss 232 is configured to connect to the power spring. Other configurations of the ring 224 than that depicted in FIG. 5 may of course be used.

Figure 6:
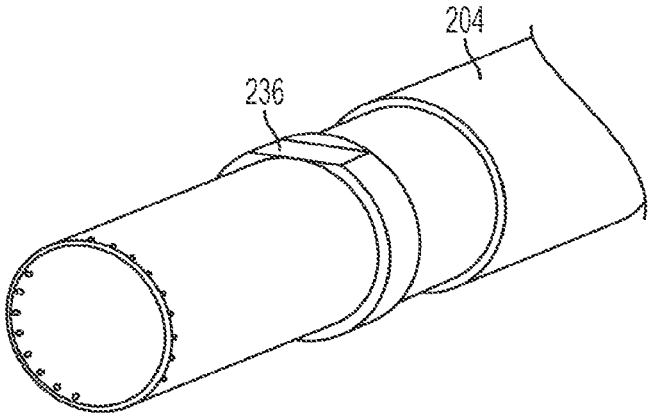
FIG. 6 is a perspective view of part of a flow tube of the safety valve of FIG. 1 according to one aspect of the present invention.

FIG. 6 depicts via perspective view one example of part of the flow tube 204. The flow tube 204 can include a flat surface 236 on an outer wall of the flow tube 204. The flat surface 236 can allow a top subassembly to contact the flow tube 204. For example, when a closing assembly closes and the flow tube 204 moves toward the surface relatively rapidly, the flow tube 204 can stop when the flow tube 204 contacts the top subassembly and energy can be dissipated at the top subassembly, as opposed to a piston contacting a piston upstop.

Figure 7:
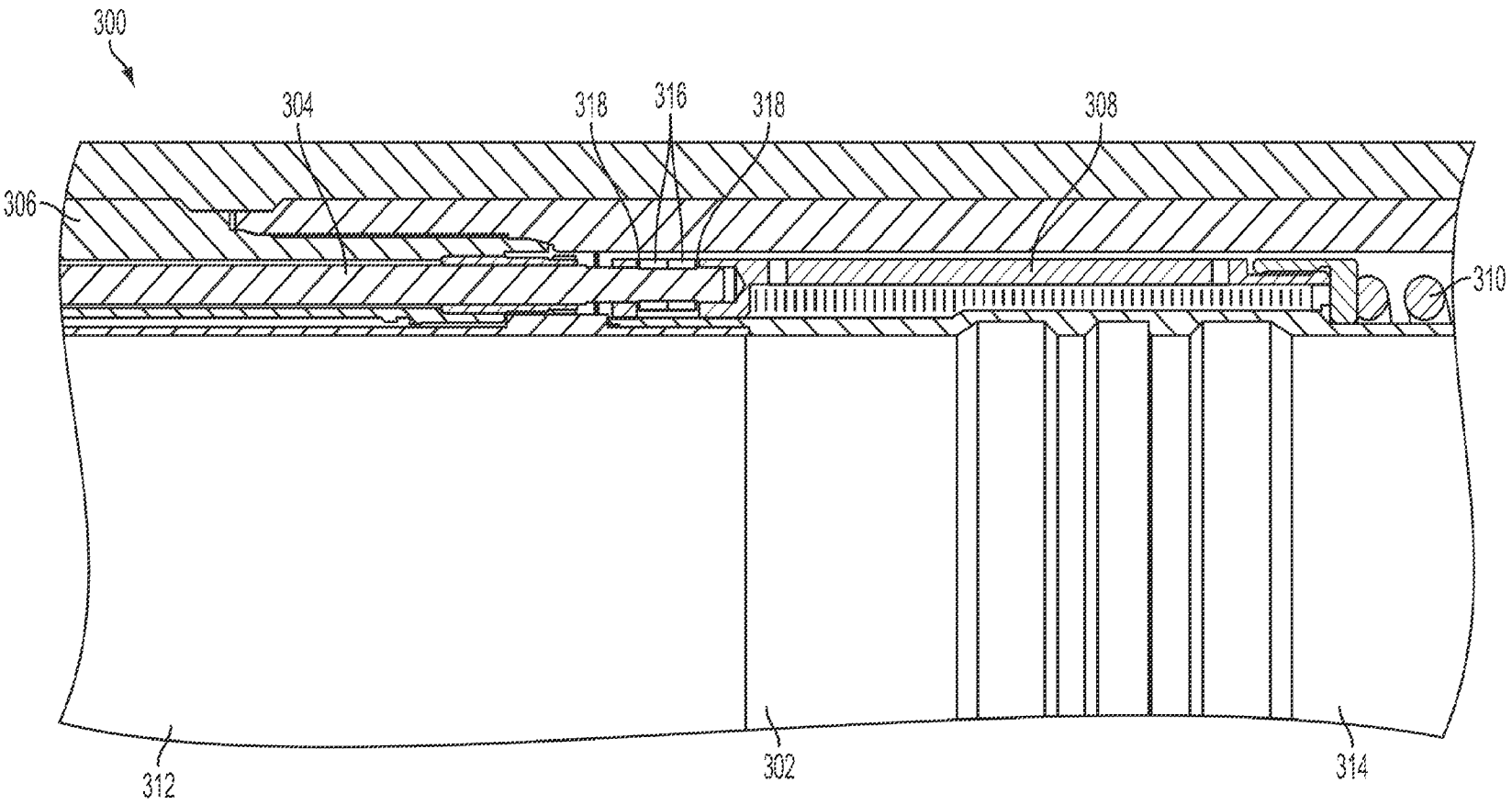
FIG. 7 is a cross-sectional side view of part of a safety valve according to another aspect of the present invention.

FIG. 7 depicts via cross-section part of a safety valve 300 according to another aspect. The safety valve 300 shown includes a flow tube 302, a piston rod 304 in a top subassembly 306, a connecting assembly 308, and a spring 310.

The flow tube 302 includes a first component 312 coupled to a second component 314. The first component 312 can rest against the top subassembly 306.

The connecting assembly 308 is similar to the previously described connecting assembly, except that the connecting assembly 308 can be round without reduced areas to provide different coupling provides with respect to the piston rod 304.

Two coupling mechanisms 316 couple the piston rod 304 to the connecting assembly 308. An example of a coupling mechanism is a nut, or a bolt and nut combination. Gaps 318 may be between the coupling mechanism 316 and the connecting assembly 308. The gaps 318 may be relatively small and may allow the piston rod 304 to move at least partially independent with respect to the connecting assembly 308. For example, when the flow tube 302 stops moving toward the surface, the first component 312 contacts the top subassembly 306 but the gaps 318 allow the piston (not shown) associated with the piston rod 304 to contact a piston upstop seat.

In other implementations, the coupling mechanisms 316 can be adjusted away from the surface, such as by one quarter inch such that the first component 312 is prevented from contacting the top subassembly 306, but the piston is allowed to be forced against the upstop by the power spring 310.

The foregoing description of the aspects and examples, including illustrated features, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

The invention claimed is:

1. A safety valve configured for being disposed in a wellbore through a fluid-producing formation, the safety valve comprising:

a piston assembly controllable from a surface of the wellbore;

a flow tube;

a closing assembly for allowing and preventing fluid flow through an end of the flow tube; and a connecting assembly positioned between the flow tube and the piston assembly, the connecting assembly being configured to allow the flow tube to move toward the surface of the wellbore in response to a closing force exerted on the flow tube by the closing assembly and at least partially independent of movement toward the surface of the wellbore by at least part of the piston assembly;

wherein the connecting assembly comprises a ring that is removably coupled to the flow tube, the ring comprising a first longitudinal end configured to couple with the piston assembly and a second longitudinal end configured to couple with a power spring, the first longitudinal end having a first diameter and a second longitudinal end having a second diameter larger than the first diameter, the second longitudinal end defining a boundary of a chamber configured to receive part of the flow tube as the flow tube moves toward the surface of the wellbore in response to the closing force, wherein a take-up spring is disposed in the chamber, the take-up spring being normally biased away from the surface of the wellbore.

2. The safety valve of claim 1, wherein the connecting assembly is configured to allow the flow tube to move toward the surface of the wellbore at least partially independent of movement toward the surface of the wellbore by at least part of the piston assembly by allowing the flow tube to move more than a corresponding amount by which a piston rod of the piston assembly moves toward the surface.

3. The safety valve of claim 1, further comprising:

the power spring disposed external to the flow tube and configured for biasing the flow tube normally towards the surface of the wellbore, wherein the piston assembly comprises:

a port for receiving hydraulic fluid from a control line;

a piston controllable by the hydraulic fluid introduced into the wellbore from the surface; and a piston rod controllable by the piston, wherein the ring is positioned external to the flow tube, coupled to the piston rod, and configured to engage the power spring; and wherein the closing assembly comprises a normally-closed flapper positioned proximate to an end of the flow tube, the normally-closed flapper being configured to apply the closing force to the flow tube.

4. The safety valve of claim 3, wherein the ring is coupled to the piston rod by coupling mechanisms, the safety valve further comprising gaps between the coupling mechanisms and the ring, wherein the gaps are configured to allow the piston rod to move at least partially independent to the ring.

5. The safety valve of claim 1, wherein the connecting assembly is configured to allow the flow tube to move toward the surface of the wellbore by one-half inch or more at least partially independent of movement toward the surface of the wellbore by at least part of the piston assembly.

6. The safety valve of claim 1, wherein the connecting assembly is configured to allow the flow tube to move toward the surface of the wellbore by an amount that is in a range of one inch to six inches at least partially independent of movement toward the surface of the wellbore by at least part of the piston assembly.

7. The safety valve of claim 1, wherein the take-up spring is configured for being compressed by the flow tube in response to the closing force and in response to the flow tube moving at least partially independent to movement by the piston assembly.

8. The safety valve of claim 1, wherein:

the first longitudinal end is coupled to the piston assembly;

the second longitudinal end is coupled to the power spring that supports the flow tube; and the ring is configured to allow the flow tube to move toward the surface of the wellbore in response to the closing force exerted on the flow tube by a flapper and at least partially independent of movement toward the surface of the wellbore by at least part of the piston assembly.

9. A connecting assembly for a safety valve configured for being disposed in a wellbore through a fluid-producing formation, the connecting assembly comprising:

a first end for coupling to a piston assembly and comprising a first diameter;

a second end for engaging a power spring that supports a flow tube and comprising a second diameter larger than the first diameter, the second end defining a boundary of a chamber configured to receive part of the flow tube;

a spring disposed in the chamber and being normally biased away from the surface of the wellbore; and a receiving member configured to allow the flow tube to move toward the surface of the wellbore and into the chamber in response to a closing force exerted on the flow tube by a flapper and at least partially independent of movement toward the surface of the wellbore by at least part of the piston assembly.

10. The connecting assembly of claim 9, further comprising:

a ring comprising the first end and the second end, the ring being configured for defining the receiving member;

wherein the spring is configured for being compressed by the flow tube in response to the closing force and in response to the flow tube moving at least partially independent to movement by the piston assembly.

11. The connecting assembly of claim 9, wherein the receiving member is configured to allow the flow tube to move toward the surface of the wellbore at least partially independent of movement toward the surface of the wellbore by at least part of the piston assembly by allowing the flow tube to move more than a corresponding amount by which a piston rod of the piston assembly moves toward the surface.

12. The connecting assembly of claim 9, wherein the receiving member is configured to allow the flow tube to move toward the surface of the wellbore by one-half inches or more at least partially independent of movement toward the surface of the wellbore by at least part of the piston assembly.

13. The connecting assembly of claim 9, wherein the connecting assembly is configured to allow the flow tube to move toward the surface of the wellbore by an amount that is in a range of one inch to six inches at least partially independent of movement toward the surface of the wellbore by at least part of the piston assembly.

14. The connecting assembly of claim 9, wherein the first end comprises openings configured to receive part of the piston assembly, wherein the second end comprises a raised boss.

15. A safety valve configured for being disposed in a wellbore through a fluid-producing formation, the safety valve comprising:

a piston rod controllable by (i) a piston and (ii) hydraulic fluid introduced into the wellbore from the surface;

a flow tube;

a normally-closed flapper positioned proximate to an end of the flow tube for allowing and preventing fluid flow through the end of the flow tube; and a ring assembly positioned between the flow tube and the piston rod and removably coupled to an exterior part of the flow tube, the ring assembly being configured to allow the flow tube to move toward the surface of the wellbore in response to a closing force exerted on the flow tube by the normally-closed flapper and at least partially independent of movement toward the surface of the wellbore by the piston rod, wherein the ring assembly comprises a first longitudinal end configured to couple with the piston rod and a second longitudinal end configured to couple with a power spring, the first longitudinal end having a first diameter and a second longitudinal end having a second diameter larger than the first diameter, the second longitudinal end defining a boundary of a chamber configured to receive part of the flow tube as the flow tube moves toward the surface of the wellbore in response to the closing force, wherein a take-up spring is disposed in the chamber, the take-up spring being normally biased away from the surface of the wellbore.

16. The safety valve of claim 15, wherein the ring assembly is configured to allow the flow tube to move toward the surface of the wellbore at least partially independent of movement toward the surface of the wellbore by the piston rod by allowing the flow tube to move more than a corresponding amount by which a piston rod of the piston assembly moves toward the surface.

17. The safety valve of claim 15, further comprising:

the power spring disposed external to the flow tube and configured for biasing the flow tube normally towards the surface of the wellbore, a port for receiving hydraulic fluid from a control line; and a piston controllable by the hydraulic fluid introduced into the wellbore from the surface, the piston rod being controllable by the piston, wherein the ring assembly is coupled to the piston rod and configured to engage the power spring; and wherein the ring assembly is coupled to the piston rod by coupling mechanisms, the safety valve further comprising gaps between the coupling mechanisms and the ring assembly, wherein the gaps are configured to allow the piston rod to move at least partially independent to the ring assembly.

18. The safety valve of claim 15, wherein the ring assembly is configured to allow the flow tube to move toward the surface of the wellbore by one-half inches or more at least partially independent of movement toward the surface of the wellbore by the piston rod.

19. The safety valve of claim 15, wherein the ring assembly is configured to allow the flow tube to move toward the surface of the wellbore by an amount that is in a range of one inch to six inches at least partially independent of movement toward the surface of the wellbore by the piston rod.

20. The safety valve of claim 15, wherein the take-up spring is configured for being compressed by the flow tube in response to the closing force and in response to the flow tube moving at least partially independent to movement by the piston rod.

* * * * *